US008136181B2

(12) United States Patent
Roepke

(10) Patent No.: US 8,136,181 B2
(45) Date of Patent: Mar. 20, 2012

(54) SYSTEM AND METHOD FOR RETRACTABLE FURNITURE UNIT

(76) Inventor: Emmett James Roepke, New York, NY (US)

( * ) Notice: Subject to any disclaimer, the term of this patent is extended or adjusted under 35 U.S.C. 154(b) by 0 days.

(21) Appl. No.: 12/697,181

(22) Filed: Jan. 29, 2010

(65) Prior Publication Data

US 2010/0132113 A1 Jun. 3, 2010

Related U.S. Application Data

(63) Continuation-in-part of application No. 10/543,306, filed on Dec. 13, 2005, now Pat. No. 7,665,161, which is a continuation-in-part of application No. 10/351,515, filed on Jan. 27, 2003, now Pat. No. 6,829,791.

(30) Foreign Application Priority Data

Jan. 26, 2004 (WO) ..... 2004/001900

(51) Int. Cl.
*A47C 17/84* (2006.01)

(52) U.S. Cl. ..... 5/10.1; 5/166.1

(58) Field of Classification Search ..... 5/10.1, 5/10.2, 166.1, 166.2, 905
See application file for complete search history.

(56) References Cited

U.S. PATENT DOCUMENTS

| | | | | |
|---|---|---|---|---|
| 614,377 | A | 11/1898 | Evans | |
| 931,962 | A * | 8/1909 | Rountree | 5/10.2 |
| 1,065,740 | A * | 6/1913 | Sorlien | 5/10.2 |
| 1,197,035 | A | 9/1916 | Knudtson et al. | |
| 2,730,213 | A | 1/1956 | Roberge | |
| 2,968,048 | A | 1/1961 | Roberge | |
| 3,882,554 | A * | 5/1975 | Glass | 5/10.1 |
| 4,058,860 | A | 11/1977 | Daidone | |
| 4,586,206 | A | 5/1986 | Singer | |
| 4,631,763 | A | 12/1986 | Singer | |
| 4,837,877 | A * | 6/1989 | Hamada et al. | 5/10.2 |
| 4,853,989 | A | 8/1989 | Garcia | |
| 5,020,169 | A | 6/1991 | Hamada et al. | |
| 5,101,523 | A | 4/1992 | Bright | |
| 5,363,520 | A * | 11/1994 | Lyne, Jr. | 5/11 |
| 5,377,787 | A * | 1/1995 | Chabrier | 187/404 |
| 5,943,714 | A * | 8/1999 | Dignam | 5/10.1 |
| 6,401,276 | B1 | 6/2002 | Sherman | |
| 6,507,962 | B2 | 1/2003 | Thurston | |
| 6,829,791 | B2 * | 12/2004 | Roepke | 5/10.1 |
| 7,874,026 | B2 * | 1/2011 | Gudenkauf | 5/11 |
| 7,878,026 | B2 | 2/2011 | Gudenkauf | |
| 2002/0074910 | A1 | 6/2002 | Reppas et al. | |
| 2002/0148041 | A1 | 10/2002 | Sherman | |

* cited by examiner

*Primary Examiner* — Michael Trettel

(74) *Attorney, Agent, or Firm* — Goodwin Procter LLP

(57) ABSTRACT

A retractable bed is disclosed which can be raised and lowered in a vertical fashion. The retractable bed includes a frame for holding a mattress; and a counterbalance system to raise and lower the bed through vertical displacement. When the bed is in the lowered configuration it will come into contact with the floor thereby permitting a person to sleep on the bed. When the bed is in the raised configuration it will be near the ceiling thereby permitting a person to pass under the bed. The counterbalance system provides a convenient way to take the bed down and to put it away.

10 Claims, 15 Drawing Sheets

SYSTEM AND METHOD FOR RETRACTABLE FURNITURE UNIT

CROSS-REFERENCE

This application is a continuation-in-part of U.S. patent application Ser. No. 10/543,306, filed on Dec. 13, 2005, now U.S. Pat. No. 7,665,161, which is a continuation-in-part of application Ser. No. 10/351,515, filed on Jan. 27, 2003, now U.S. Pat. No. 6,829,791, the disclosure of which is hereby incorporated herein by reference in its entirety.

INVENTIVE FIELD

The present invention generally relates to furniture structures and, more particularly, to a mechanically retractable furniture unit.

BACKGROUND

The trend of so-called urban flight has reversed itself in the last twenty years, with individuals and families moving back into urban areas from the suburbs and beyond. Most major cities have enjoyed something of a renaissance as long-neglected downtown districts have been revitalized and commercialized. In short, the American city is being celebrated with great vigor by those who only a few decades ago were fleeing it in droves. Washington, D.C., for example, has seen its "old downtown" area redeveloped and its population has spiked over the last decade. New York City, the jurisdiction some considered "ungovernable" only twenty years ago, has enjoyed a spectacular resurgence as the financial and cultural capital of urban America.

The back-to-the-city trend has been facilitated by redevelopment to accommodate new residents—some individuals, some couples, and some families. In some cases, former commercial districts have been mixed with residential construction. In some cases, manufacturing or similar commercial structures have been converted into trendy apartments, condominiums, or co-opts. That being said, space is still a premium in urban environments and many residents find it a challenge to comfortably furnish their dwellings with the space available. This issue can be critical in small apartments, such as studio apartments.

A variety of design trends and systems have been developed as a result of the space issue in urban residential dwellings. For example, lofts which provide an elevated area for a bed or couch are found in some apartments. Futons function as a (typically uncomfortable) bed when folded out and as a (typically unglamorous) couch when folded up. Convertible sofas provide improved functionality and aesthetics by also providing a bed in one configuration and a sofa in another. The prior art has also produced beds which fold up into the wall.

Each of these prior art approaches to the space problem has its drawbacks. Typical lofts obviously require special construction. This can entail significant cost. Also, many average sized rooms are simply not big enough to accommodate a loft.

Futons provide limited functionality and comfort as a bed. As the typical person who has spent more than a few weeks sleeping on a futon can attest, sleeping on a futon is simply not the same experience as sleeping on a standard construction full-size bed.

Beds that fold up or pivot into the wall are an improvement, but a fair amount of horizontal space is sacrificed. The two or three feet that must be given up may be significant, even intolerable, in apartments have rooms with tight dimensions.

U.S. Pat. No. 4,853,989 to Garcia discloses a retractable bed that folds up into a false ceiling. The Garcia approach requires a complex folding structure with at least two pivot points that requires the use of a non-standard bed. Also, because the Garcia system requires rotation about two axes to open the bed, it is not readily amenable to an automated mechanism for opening and closing this complex structure.

Other drawbacks and disadvantages exist in the prior art.

SUMMARY

According to one embodiment, the present invention is directed to a retractable bed that can be automatically raised and lowered in a vertical fashion. The retractable bed includes a frame for holding a mattress; and mechanism for raising and lowering the bed through vertical displacement, such as one or more motors. When the bed is in the lowered configuration it will come into contact with the floor thereby permitting a person to sleep on the bed. When the bed is in the raised configuration it will be near the ceiling thereby permitting a person to pass under the bed. The mechanism for raising and lowering the bed, such as one or more motors, provides an automated and convenient way to take the bed down and to put it away.

According to one further aspect of the invention, the retractable bed uses a motor that is fixably situated away from the bed. In this embodiment, the motor is controlled to move the bed up and down while the motor remains stationary.

According to another aspect of the invention, the retractable bed uses a motor, preferably two motors, that are integrated with or coupled to the bed/frame. In this embodiment, the motor(s) is controlled to move the bed up and down, the motor(s) moving with the bed.

In another disclosed embodiment, a retractable bed includes a bed including a frame adapted to accommodate a mattress and legs, support lines secured at one end to the frame at the four support points, a first block assembly disposed away from the frame and a second block assembly disposed above the frame, the second block assembly guiding the support lines from above the frame to the first block assembly, and a counterweight system neutrally weighted to the weight supported at a distal end by the support lines. The counterweight is disposed separately from the bed and moves the bed through vertical displacement. The counterweight system includes a drive cable mechanically driven by a crank, an adjustable weight connected to the support lines through the first block assembly and connected to the drive cable, and vertical rails confining the weight to translate along the vertical rails when the drive cable is driven by the crank.

Other embodiments, variations, and enhancements are disclosed.

The advantages of the present invention are numerous. The invention greatly mitigates the space problem in dwellings with small rooms, allowing the resident to take full advantage of the available area of the room during the day. The invention does not require complex, non-standard structures. In fact, standard frames/mattresses can accommodate the invention. The solution provided by the invention is also aesthetically pleasing to the eye.

Accordingly, it is one object of the invention to address the space problem presented by dwellings with small rooms.

It is another object of the invention to provide a bed that can be automatically taken out when it is needed and put away when it is not needed.

It is yet another object of the invention to provide a retractable bed that readily accommodates standard frames and bed sizes.

These and other objects of the invention are addressed by the written description and figures contained herein.

BRIEF DESCRIPTION OF THE DRAWINGS

To facilitate a fuller understanding of the disclosed embodiments, reference is now made to the accompanying figures. These figures should not be construed as limiting, but are intended to be exemplary only.

DETAILED DESCRIPTION

Figure 1:
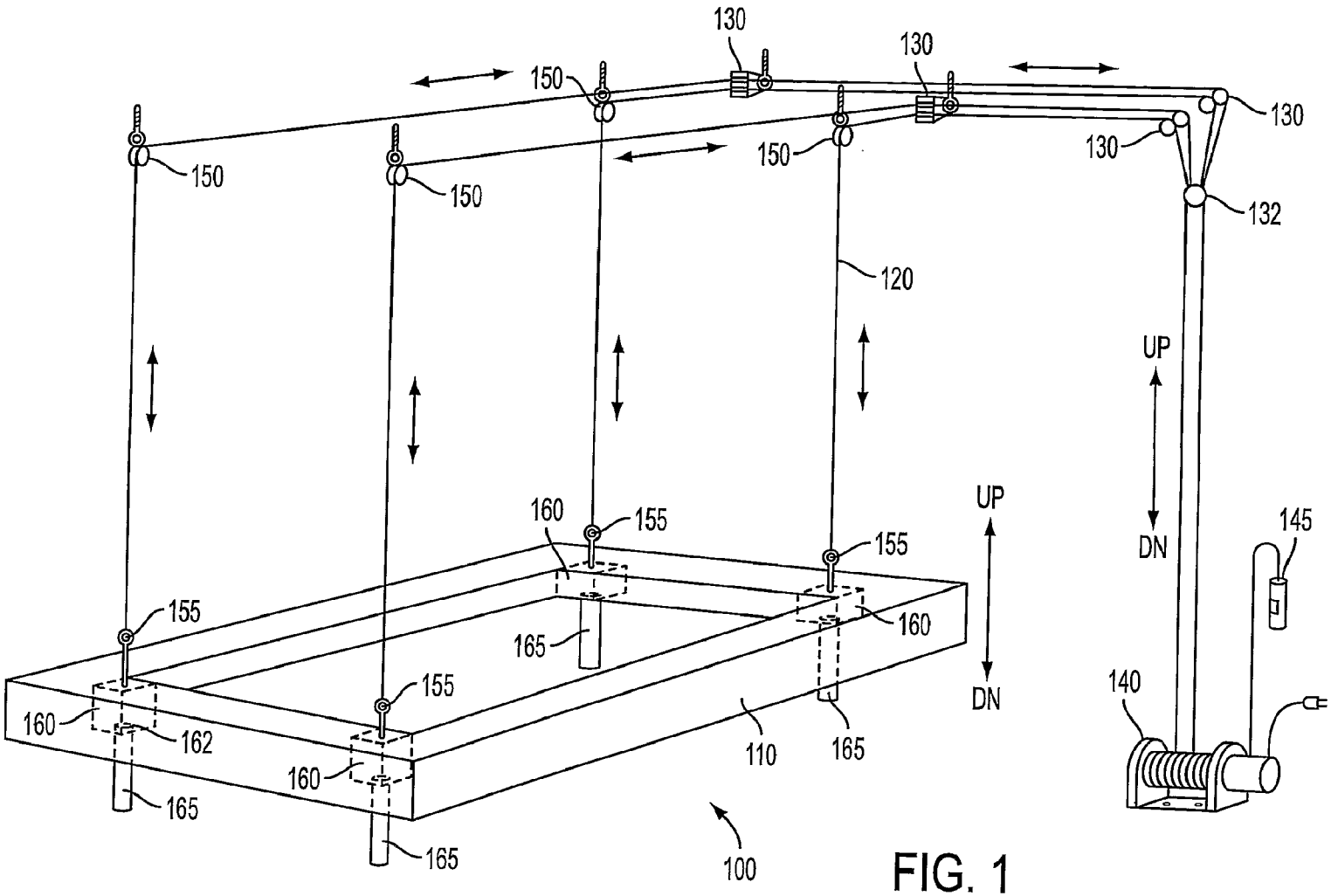
FIG. 1 is a diagram of a retractable bed system in the lowered configuration according to an embodiment of the invention.

FIG. 1 is a block diagram of a retractable bed system 100 according to an embodiment of the invention. Retractable bed system 100 includes frame 110; support lines 120; first blocks 130; double block 132; raising/lowering mechanism 140; remote control unit 145; second blocks 150; eye hooks 155; internal blocking 160; flange 162; and legs or support blocks 165.

Generally, the operation of retractable bed system is as follows. Raising/lowering mechanism 140 is operated or controlled using remote control unit 145 in order to raise or lower frame 110. A block structure comprising first blocks 130, double block 132, second blocks 150, and support lines 120 is used to transfer the load of the frame (and related structure) to raising/lowering mechanism 140. Accordingly, when raising/lowering mechanism 140 is operated to raise the bed the support lines 120 are drawn in or pulled in order to raise frame 110 from the floor to a position adjacent to the ceiling (not shown). When raising/lowering mechanism 140 is operated to lower the bed the support lines 120 are extended or paid out in order to lower frame 110 from a position adjacent to the ceiling down to the floor. In either instance, the frame 110 is vertically displaced up or down to place the bed in the desired position.

Raising/lowering mechanism 140 preferably comprises a electric motor that pays out or takes in support lines 120. According to one embodiment, raising/lowering mechanism 140 is a step-type motor that precisely controls movement of frame 110, although most compact commercial grade motors will suffice. According to one embodiment, raising/lowering mechanism 140 is an electric hoist manufactured by Central Machinery (Item # 44006 listed as 12SB).

Raising/lowering mechanism 140 is fixably attached separate from the bed, such as to the floor or a wall. Raising/lowering mechanism 140 will be stationary as the frame 110 is being raised/lowered.

Remote control unit 145 comprises a device for remotely controlling raising/lowering mechanism 140. Remote control unit 145 may be connected to raising/lowering mechanism 140 by a cord or line, although preferably it is not physically attached. Thus, preferably remote control unit communicates with raising/lowering mechanism 145 through radio signals, infrared signals, or acoustic signals that obviate the need for a physical connection. Remote control unit 145 could also be a conventional electrical switch, such as one mounted on the wall.

Support lines 120 support the load of frame 110 and associated components. Support lines 120 can be any wire, cable, tether or the like with sufficient strength and reliability to support the load. According to one embodiment, support lines 120 are nautical structure lines, for example, nautical nylon line by West Marine (⅝; inch diameter) or aircraft wire (⅛inch diameter).

Frame 110 is the structural component of the bed. According to one embodiment, frame 110 is a standard-type bed frame (e.g., twin, king, queen, or other standard size) that has been adapted for the various embodiments. According to another embodiment, frame 110 is specially designed for the various embodiments. For example, frame 110 may be built using light material, such as a light wood, aluminum, plastic or other synthetic, in order to reduce the load on the system. According to one approach, frame 110 is custom built from plywood and pine wood. According to another approach, frame 110 is built using light weight metal plates and metal wire structure covered in polyurethane foam mold. According to this latter approach, the frame may be built in two sections that allow for easy transportation and then assembly on-site using a simple lock system. The frame would be bolted at the width (rather than the length) so that the motors are not affected (see FIG. 5 embodiment).

First blocks 130 and second blocks 150 comprise blocks for transferring the load between raising/lowering mechanism 140 and frame 110. Preferably, first blocks 130 are double blocks mounted on eye hooks (attached to the ceiling), while second blocks 150 are single blocks mounted on eye hooks (attached to the ceiling). According to one approach, first blocks 130 and second blocks 150 are West Marine nautical blocks at ⅝" diameter. Note that the term "blocks" comprises pulleys as commonly understood.

Double block 132 transfers the load from the single line emanating from raising/lowering mechanism 140 to a pair of lines routed to frame 110. According to one approach, double block 132 is a West Marine nautical block at ⅝" diameter.

Eye hooks 155 are standard eye hooks which in this application are used to couple blocks to the ceiling or wall, or to couple lines to the bed frame. Other suitable mechanisms for connecting blocks or the lines could be employed.

It should be understood by the skilled artisan that alternative configurations of the block arrangement are readily accommodated, and do not depart from the spirit and scope of the disclosed embodiments. For example, multiple lines could emanate from raising/lowering mechanism 140, rather than a single line.

Internal blocking 160 and flange 162 provide structure within the frame 110 for coupling the lines to the frame and for coupling legs or support blocks 165 to the frame. Preferably, internal blocking 160 is constructed of wood, although other materials, such as metal, plastic, or other synthetics could be used.

Legs or support blocks 165 provide the interface between the frame 110 and the floor (not shown). Preferably, legs or support blocks 165 are legs as commonly understood, although rectangular support blocks providing similar functionality and a modern aesthetic could be employed. Legs or support blocks 165 can be removable. For example, they may be threaded so that they can be inserted and removed by screwing/unscrewing. Other mechanisms for permitting easy insertion/removal of legs or support blocks 165, while reliably holding them while in place, can be employed, such as fixed mechanical legs that are in threaded sockets that lock into place in the open and closed positions. Ideally, the four legs for the bed would be mechanical and would go up and down (open and close) with the motor.

Legs or support blocks 165 can also be extendable/retractable. For example, there may be one or more motors, such as one motor for each leg, for causing the legs/support blocks 165 to extend (for when the bed is to be in the lowered configuration) and for causing legs/support blocks 165 to retract (for when the bed is in the raised configuration). According to one aspect, remote control device 145 can be used to control the extension/retraction of legs/support blocks 165. According to another aspect, legs/support blocks can be automatically caused to extend/retract when the frame 110 is being lowered/raised. For example, remote control device 145 may automatically cause the legs/support blocks 165 to retract when the user initiates raising, and to extend when the user initiates lowering. This would prevent inadvertent damage to the frame/floor in certain scenarios.

Whether the legs/support blocks 165 are removable or retractable, a covering for an exposed orifice when the legs are removed/retracted may be provided. For example, covers of the appropriate geometry could be inserted over the holes. These covers could be manually inserted by the user or they could be automatically inserted (e.g., slid over the hole under the control of a small motor).

According to another aspect, mechanism for raising and lowering 140 may be adapted to allow a maximum amount of displacement so as to avoid damage to the ceiling or the floor. For example, such mechanism may comprise a motor 140 that is programmable, or which otherwise can be set, so that the frame 110 is not raised beyond the point where it should be raised (thereby avoiding damage to the ceiling), and/or so that the frame is not lowered beyond the point where it should be lowered (thereby avoiding support lines 120 sagging and/or the frame 110 not fully resting on the floor).

To accommodate the aforementioned, the retractable bed may include at least one sensor for determining when the bed is in the lowered configuration. There may be at least one sensor for determining when the bed is in the raised configuration. Such sensors may be mechanical devices or optical devices (laser sensors, well understood in the art) or electrical devices (e.g., switches) for measuring displacement of the unit. Additionally, the unit may also include an output device for outputting a visual or acoustic indicia that the bed is in the lowered configuration. The unit may include an output device for outputting a visual or acoustic indicia that the bed is in the raised configuration. The aforementioned output devices may provide an output (visual indicia or acoustic "beep") to indicate that the bed has arrived at the raised/lowered configuration, and/or provide an output (e.g., an emphasized visual indicia or a louder beep) to indicate when raising/lowering mechanism 140 is attempting to raise/lower the frame 110 beyond the point at which it should be raised/lowered.

According to yet another aspect, one or more light fixtures may be attached for use when the unit is in the raised configuration. For example, such a light fixture can be inserted into the orifice exposed when a leg/support block 165 is removed. Alternatively, a light fixture may simply be removably attached (e.g., through a clamp) to the frame when the bed is in the raised position. Or the light fixture may be permanently attached to or integrated into the bottom of the frame.

It should be understood that the variations and enhancements discussed above regarding legs/support blocks 165 (e.g., removable or retractable), control over displacement, sensors regarding displacement, output devices regarding displacement, and integration of light fixtures, can be employed for the various embodiments of the retractable bed discussed herein. In particular, such enhancements and variations can be readily employed in connection with the alternative configuration discussed below in conjunction with FIGS. 5-9.

Figure 2:
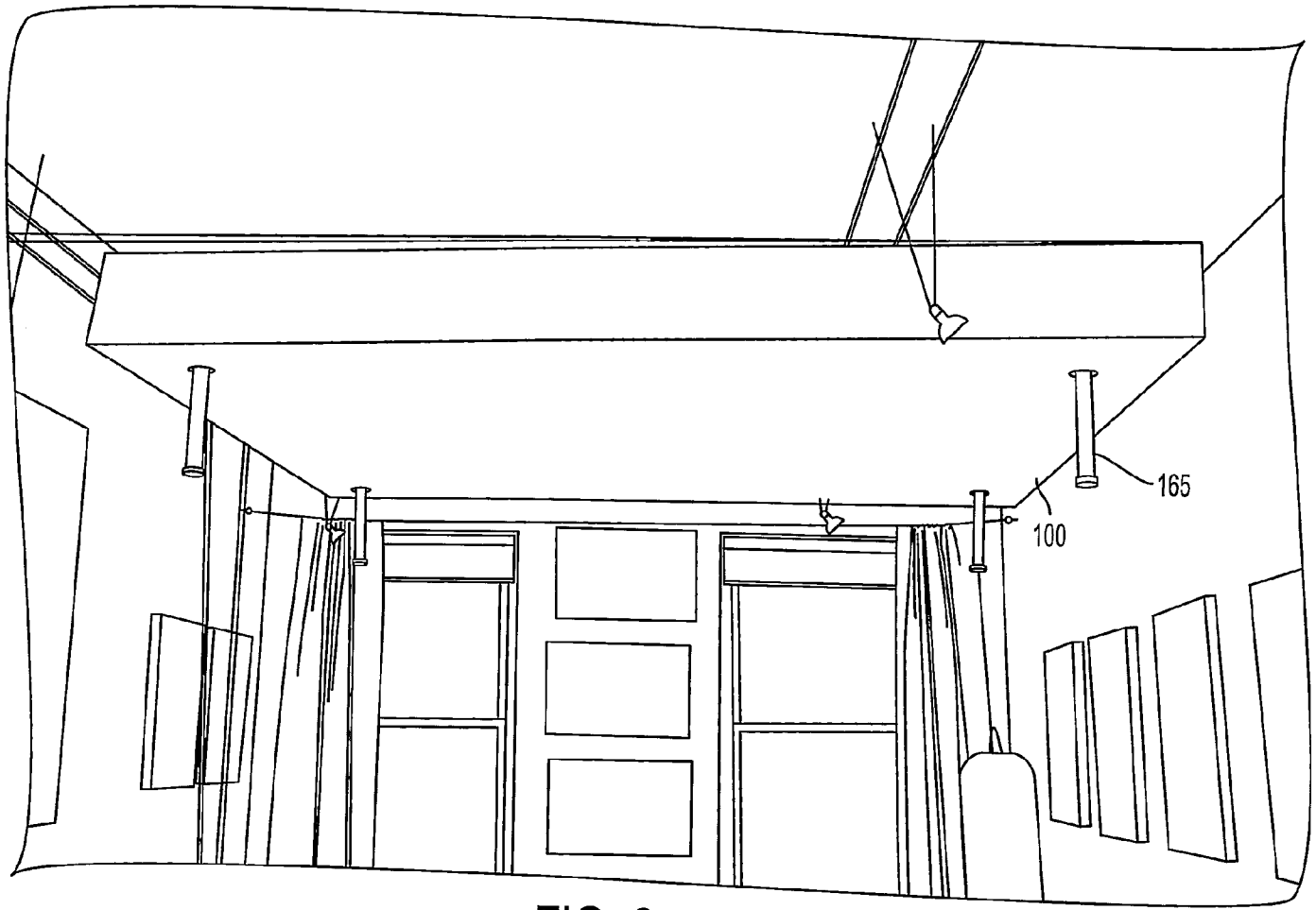
FIG. 2 is a diagram of a retractable bed system in the raised configuration according to an embodiment of the invention.

FIG. 2 is an illustration of the retractable bed system 100 in the raised position. Legs 165 are not removed or retracted in this illustration.

Figure 3:
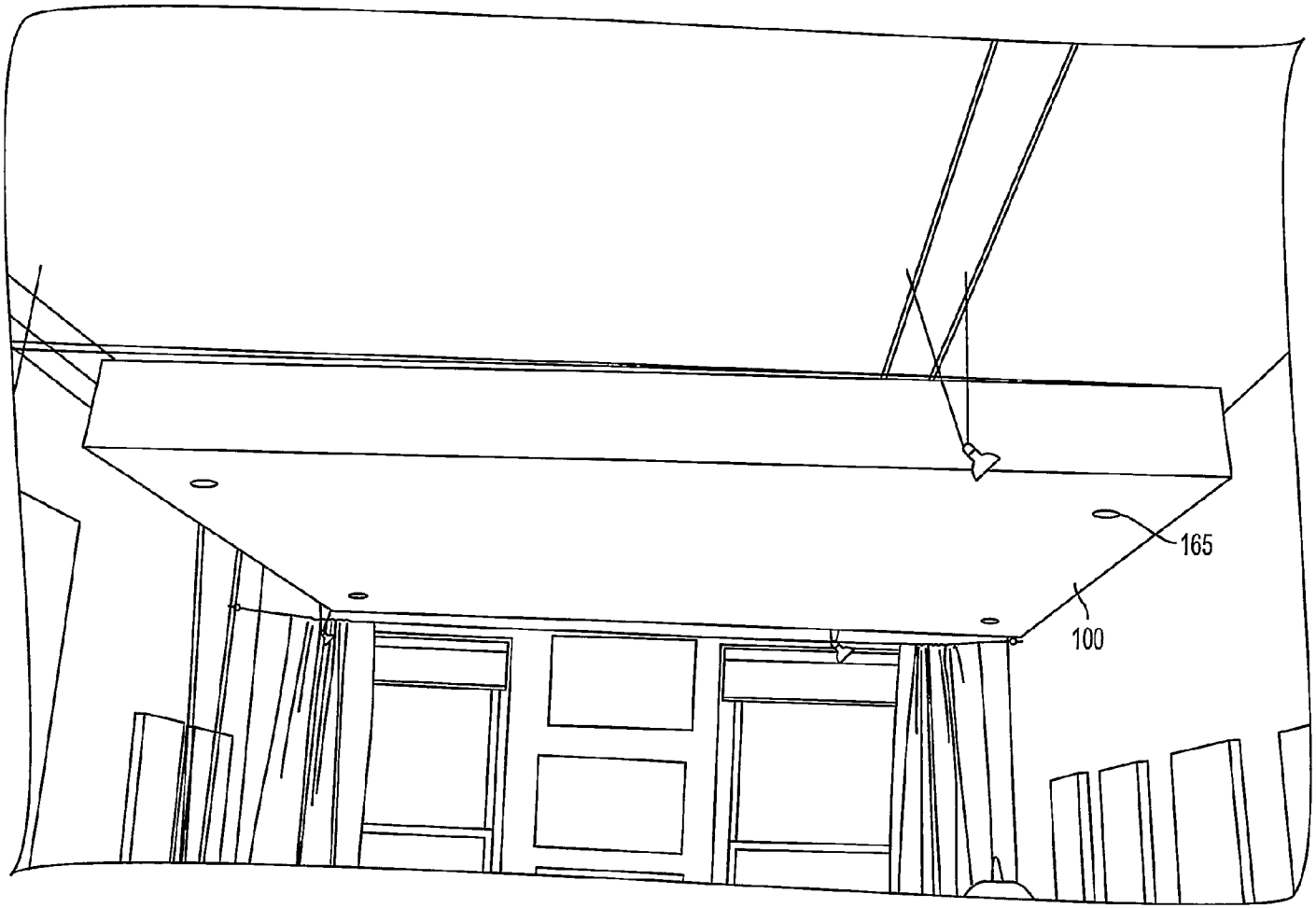
FIG. 3 is a diagram of a retractable bed system in the raised configuration with the legs removed according to an embodiment of the invention.

FIG. 3 is an illustration of retractable bed system 100 in the raised configuration with the legs 165 removed or retracted. The reader should comprehend from this illustration that the result harmonizes beautifully with a modern design aesthetic.

Figure 4:
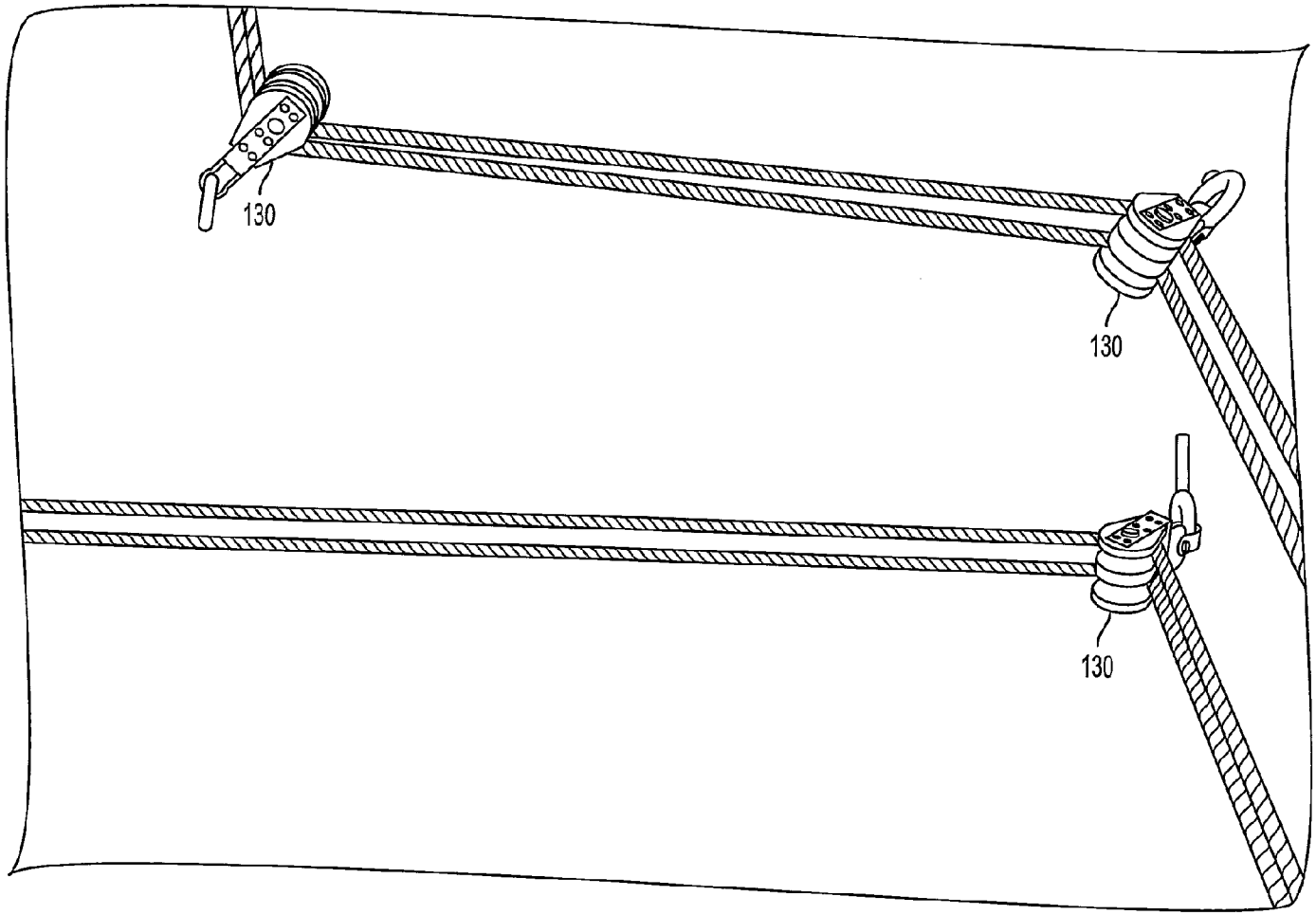
FIG. 4 is a diagram of blocks and support lines which can be employed according to an embodiment of the retractable bed system.

FIG. 4 is an illustration of a portion of the block assembly including double blocks 130 mounted to the ceiling (e.g. using eye hooks).

Figure 5:
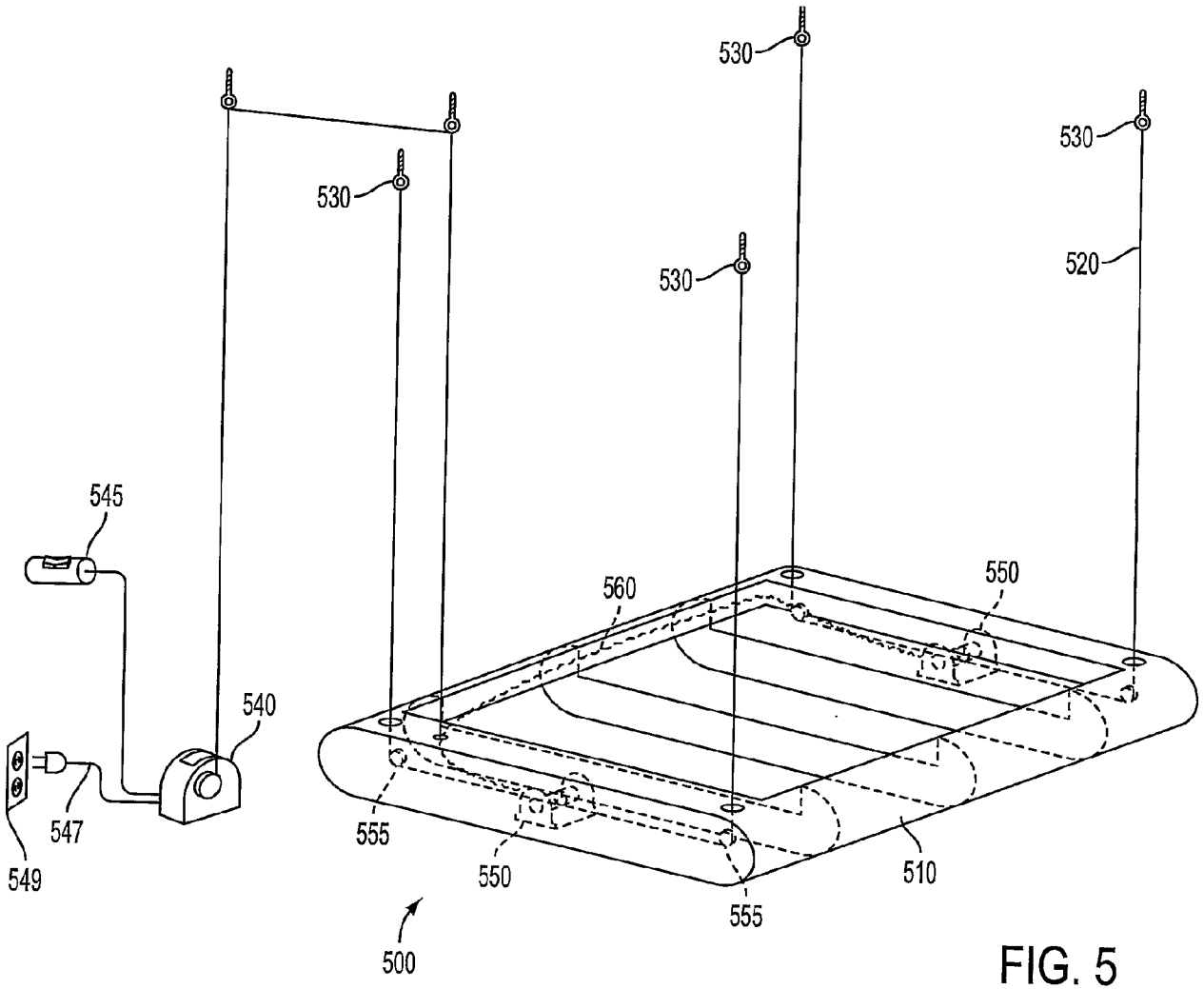
FIG. 5 is a diagram of an alternative embodiment of the retractable bed system employing a raising/lowering device(s) that moves with the bed.

FIG. 5 provides an alternative embodiment of a retractable bed system 500 using raising and lowering mechanism that are integrated into, and which move with, the frame. According to this embodiment, retractable bed system 500 includes frame 510; at least one raising/lowering mechanism 550; support lines 520; internal blocks 555; power line 560; eye hooks 530; self-winding power cord 540; remote control unit 545; plug 547; and outlet 549.

The general operation of retractable bed system 500 is as follows. Raising/lowering mechanism 550, under the control of remote control device 545, takes in or extends support lines 520 in order to raise or lower frame 110. Raising/lowering mechanism 550 is attached to and integrated with frame 510 such that it moves with frame 110 as it is raised/lowered. The load associated with frame 110 and associate structure is maintained using support lines 520 routed to raising/lowering mechanism 550 using a block structure comprising blocks 555 which are integrated with, and which therefore move with, frame 110 as it is raised/lowered. Power is fed to raising/lowering mechanism 550 using power line 560. Power line 560 may be paid out/retracted using a self-winding power cord 540 device.

Frame 510, like frame 110 of FIG. 1, may be a conventional frame that is adapted for the various embodiments. Preferably, however, frame 510 has an internal cavity designed to accommodate the internally integrated raising/lowering mechanism 550, blocks 555, and power line 560, of this embodiment. Frame 510 may have oval shaped ends that readily accommodate the internally-integrated components and which provide an attractive design feature. Frame 510 may be a custom built frame designed to be light weight and to support a specific manufactured mattress.

Raising/lowering mechanism 550 may comprise electric motors. Preferably, raising/lowering mechanism 550 comprises two motors, one for each end of the frame 510, which are synchronized to ensure the frame 510 is raised or lowered uniformly. According to another approach, a single motor 550 could be employed with a drive shaft (not shown) that would extend the length of the frame. This would ensure synchronized raising/lowering of the ends of the bed and would be cost effective and light weight.

Blocks 555 may comprise single blocks as discussed above for the single blocks of FIG. 1.

Support lines 520 may comprise any of the lines discussed above for FIG. 1. Preferably, support lines 520 comprise high strength nautical lines constructed of metal.

Eye hooks 530 may comprise the eye hooks or similar mechanism for coupling support lines to the ceiling as discussed for FIG. 1.

Self-winding power cord 540 pays out and takes in the power line 560 as the bed is being lowered or raised. According to another approach, the power could be tied into (integrated with) lines 520 so that the power cord 540 functionality would be integrated into the frame 510 rather than being outside of it.

Plug 547 provides power to the system by connection to electrical outlet 549.

Figure 6:
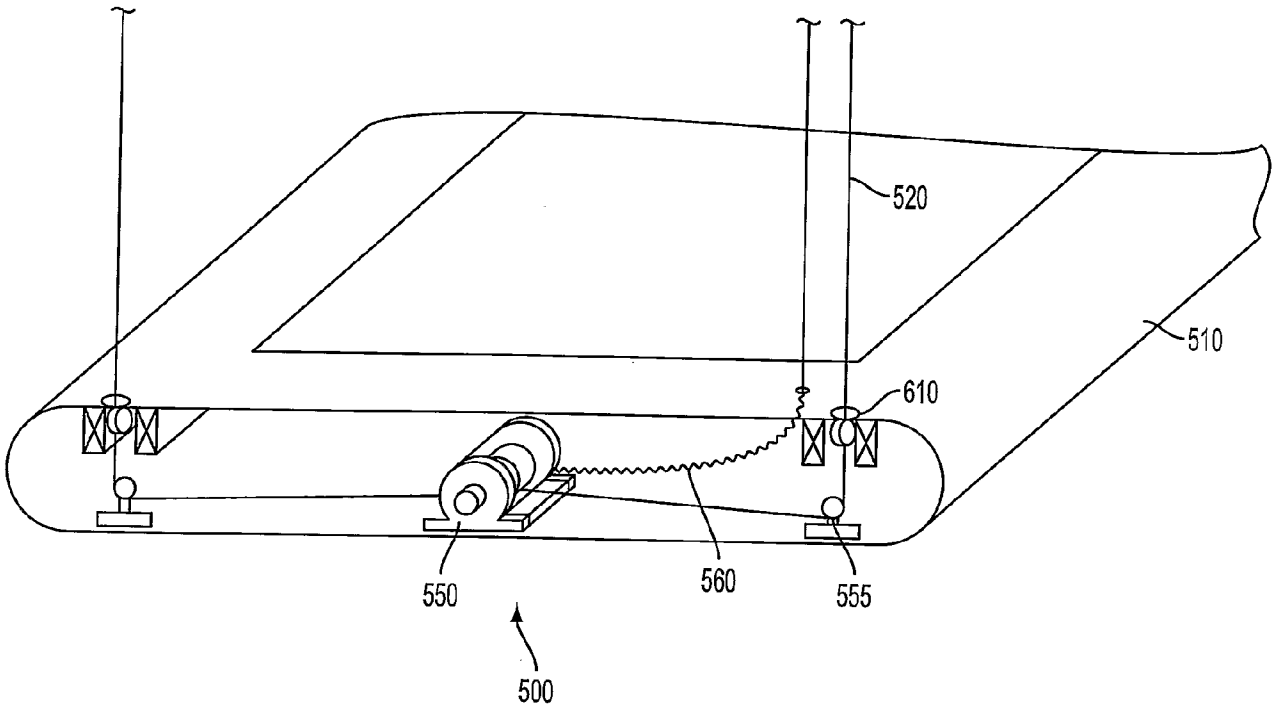
FIG. 6 is a diagram providing a sectional view of the alternative embodiment of the retractable bed system.

FIG. 6 is a diagram providing a sectional view of the alternative embodiment of the retractable bed system. FIG. 6 includes raising/lowering mechanism 550, which may comprise an electric winch; power line 560 (which may be fed to raising/lowering mechanism 550 through an orifice in frame 510); support lines 520; and flush mated blocks 610 for routing the support lines 520 to blocks 555.

Figure 7:
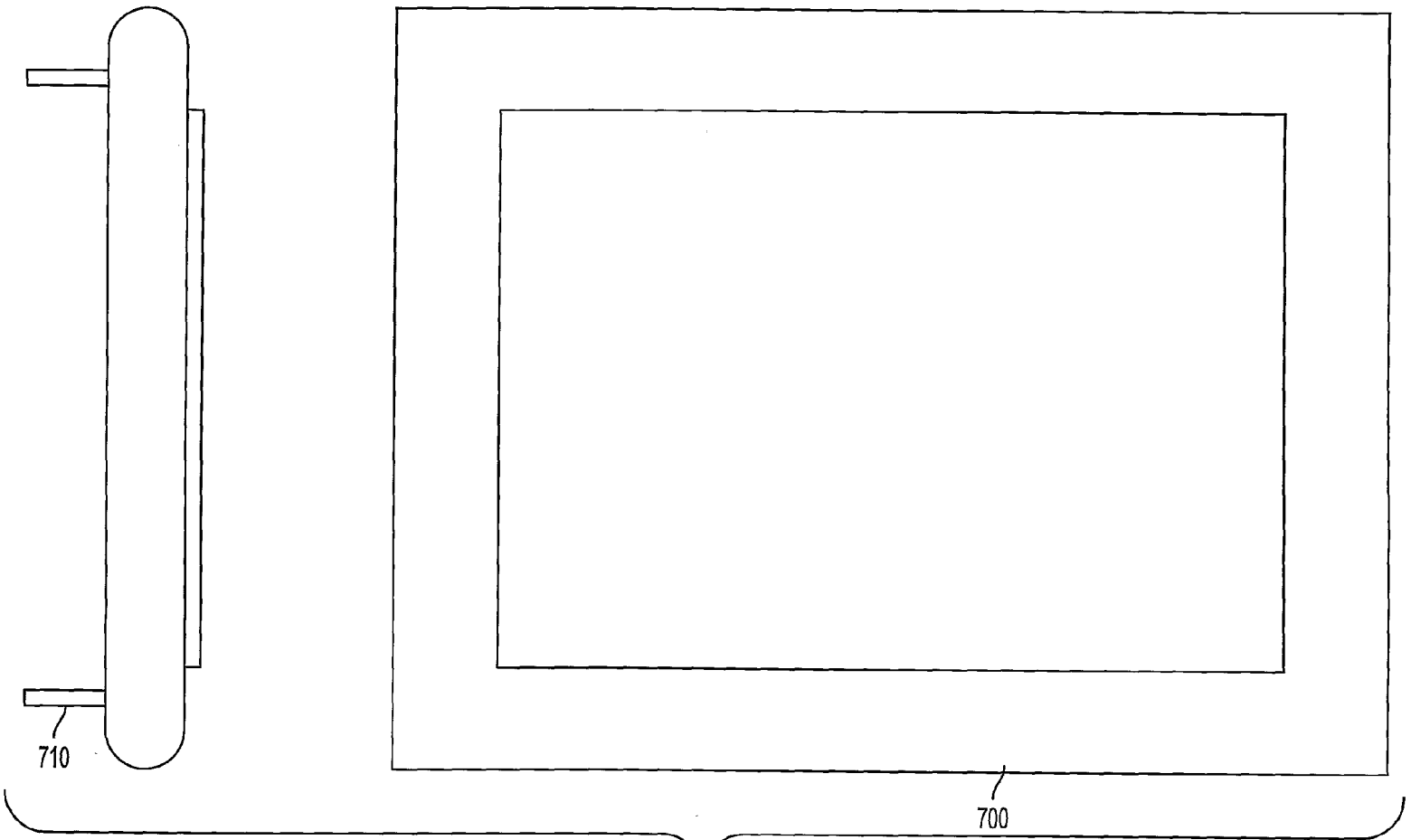
FIG. 7 is a diagram providing a top view and front view of the alternative embodiment of the retractable bed system.

FIG. 7 is a diagram providing a top view and front view of the alternative embodiment of the retractable bed system, including rectangular frame 700 and legs 710. Legs 710 may be removable or retractable (or even fixably attached), as discussed above regarding FIG. 1.

Figure 8:
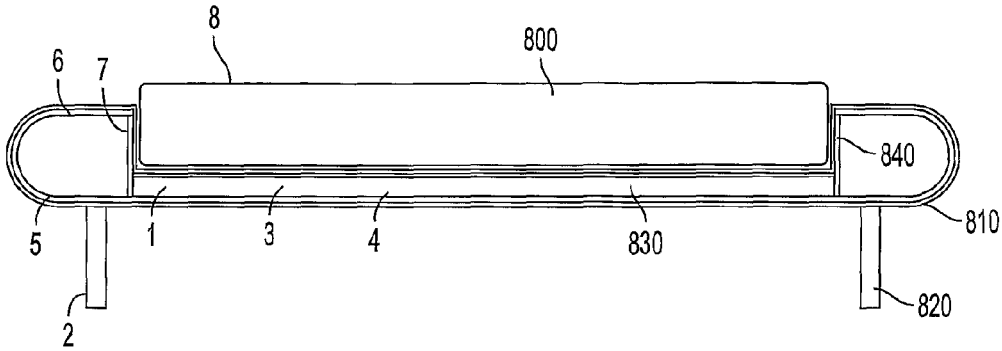
FIG. 8 is a diagram providing a front view of the alternative embodiment of the retractable bed system.

FIG. 8 is a diagram providing a front view of the alternative embodiment of the retractable bed system, including bed (mattress) 800; a frame 810 comprising side supports 840 and bottom support 830; and legs 820.

Figure 9:
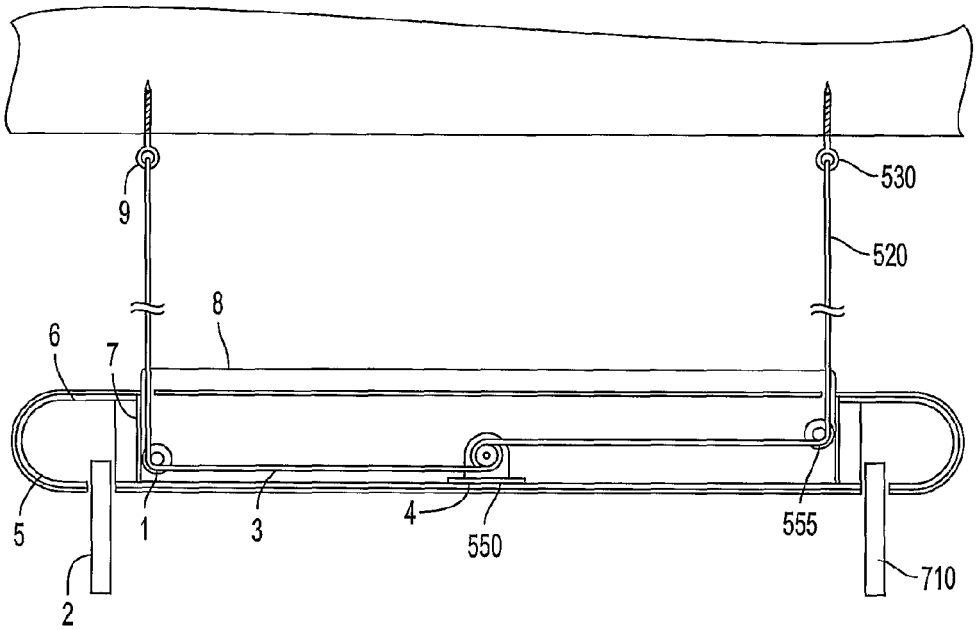
FIG. 9 is a diagram providing a sectional front view of the alternative embodiment of the retractable bed system.

FIG. 9 is a diagram providing a sectional front view of the alternative embodiment of the retractable bed system, including some of the aforementioned components.

Figure 10:
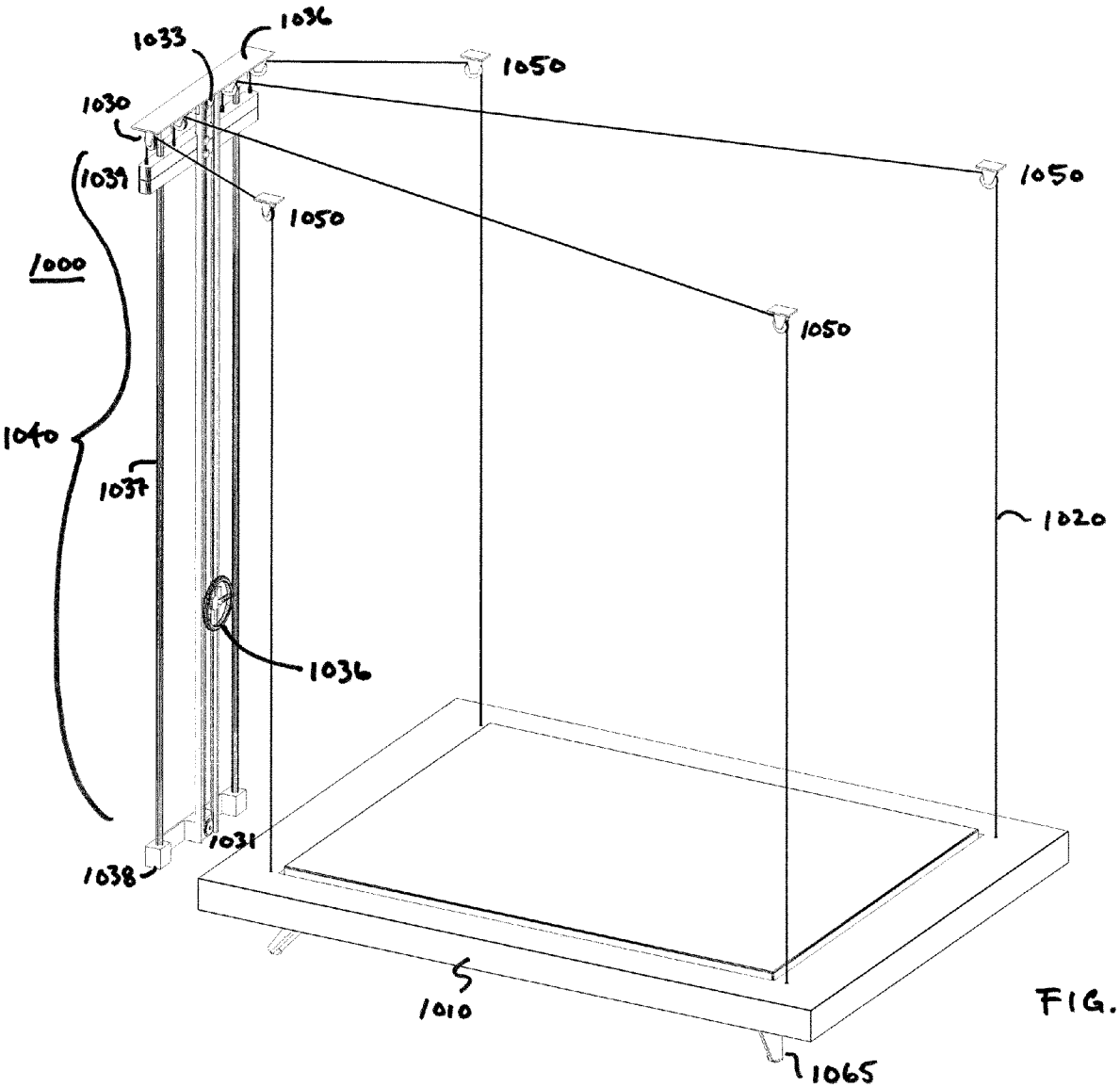
FIG. 10 is a diagram illustrating another embodiment of a retractable bed configuration.

FIG. 10 is a diagram illustrating another embodiment of a retractable bed configuration. The retractable bed system 1000 includes a frame 1010, legs 1065, support lines 1020, first blocks 1030, second blocks 1050, and a counterbalance system 1040. Optionally, the frame 1010 is primarily comprised of sustainable materials such as certified sustainable wood, bamboo or recycled plastic or metal. In the illustrated embodiment, the counterbalance system 1040 includes a weight 1039, a base 1038, a top plate 1036, rails 1037, a first pulley 1031, a second pulley 1033, a drive cable 1035 and a crank 1036. In the illustrated embodiment, the crank 1036 is a turn-crank wheel. The crank 1036 is configured to drive the drive cable 1035 in a controlled fashion clockwise or counterclockwise about the first and second pulleys 1031, 1033. In one embodiment, the pulleys 1031, 1033 are sprockets or gears with teeth that engage and drive the drive cable 1035, which in one embodiment, is a chain loop with holes engaging the teeth on the sprockets. In another embodiment, the drive cable is durable rubber or plastic that is moved about the pulleys 1031, 1033 through friction with little to no slippage. In the illustrated embodiment, the rails 1037 are fixedly secured to the base 1038 and the top plate 1036. In another embodiment, the rails 1037 are instead secured directly into the floor, the ceiling or both. The support lines 1020 are attached to the weight 1039 and the weight is configured to slide along the rails 1037. The controlled, guided counterbalance weight 1039 is also attached to the drive cable 1035.

In operation, the counterbalance system 1040 is operated to raise or lower the frame 1010. The block structure including the first blocks 1030, second blocks 1050 and the support lines 1020 are used to transfer the load of the frame and other structural elements to the counterbalance system 1040. Accordingly, when the counterbalance system 1040 is operated to raise the bed, the support lines 1020 are drawn or pulled in to raise the frame 1010 from the floor to a position adjacent to the ceiling. When the counterbalance system 1040 is operated to lower the bed, for example, by turning the crank 1036 to drive the drive cable 1035, the support lines 1020 are extended or paid out to lower the frame 1010 from a position adjacent to the ceiling down to the floor. In either instance, the frame 1010 is vertically displaced up or down to place the bed in the desired position. In one embodiment, when the turn crank wheel 1036 is rotated clockwise, it raises the counterbalance weight 1039 up towards the ceiling, thereby lowering the bed. When the turn crank wheel is rotated counter-clockwise, it lowers the counter balance weight towards the floor, thereby raising the bed. In an alternate embodiment, the crank 1036 is turned clockwise to raise the bed and vice-versa. By providing a counterbalance system in which the weight neutrally or close-to-neutrally balances the bed frame and other structural elements attached to the lines, the embodiment incorporating the counterbalance system advantageously eliminates or reduces the need for a powered motor for raising or lowering the bed. Additionally, safety is also improved, as there is no or less need for a motor inside the bed and a failure of the counterbalance system located away from the bed is less likely to cause injury to those using the bed while it is resting on the floor.

Figure 11:
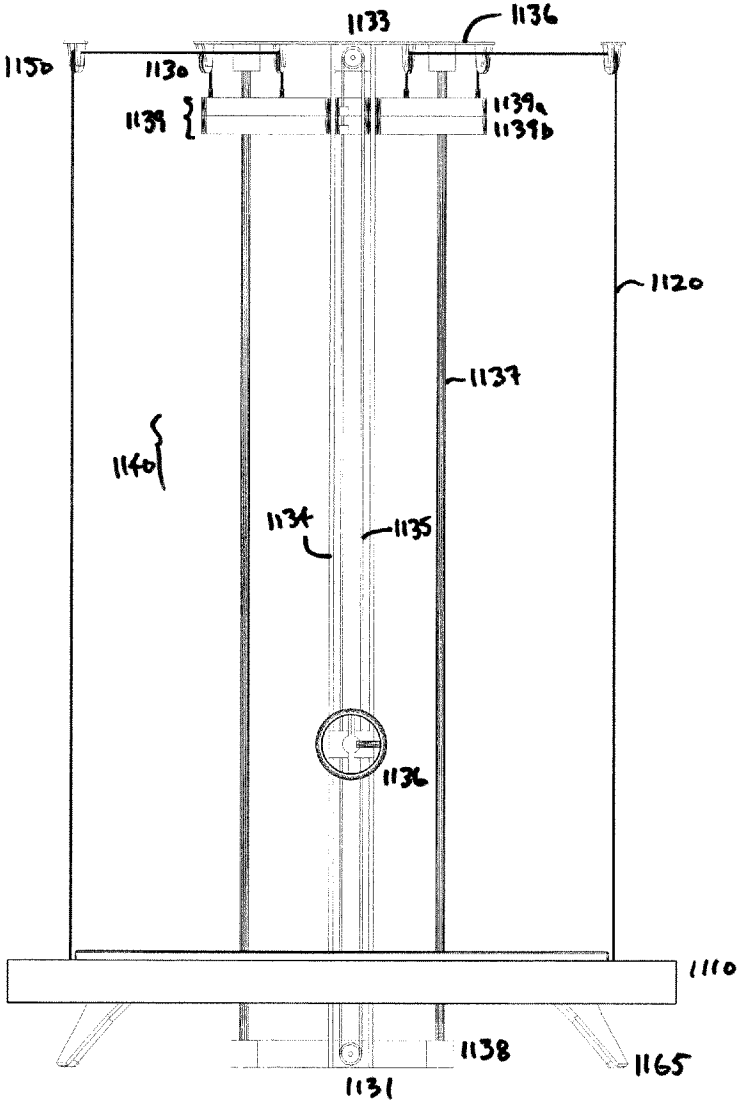
FIG. 11 is a front elevation view of an embodiment of a retractable bed configuration.

FIG. 11 is a front elevation view of an embodiment of a retractable bed configuration. The retractable bed system 1100 includes a frame 1110, legs 1165, support lines 1120, first blocks 1130, second blocks 1150 (only one pair of which is viewable), and a counterbalance system 1140. The counterbalance system 1140 includes a weight 1139, a base 1138, a top plate 1136, rails 1137, a first pulley 1131, a second pulley 1133, a drive cable 1135 and a crank 1136. The support lines 1120 are attached to the weight 1139 and the weight is configured to slide along the rails 1137. The weight 1139 is also attached to the drive cable 1135. In the illustrated embodiment, struts 1134 run parallel to the length of the drive cable 1135 and are connected to the top plate 1136 and base 1138. The weight includes a standard section **1139*a* connected to the support lines 1120 and an auxiliary section 1139*b* secured to the standard section 1139*a*. In one embodiment, the auxiliary section 1139*b* is reversibly secured to the standard section 1139*a* and also allows for affixation of additional auxiliary sections as required to balance the weight of the frame 1110, a mattress and other structures on the other side of the support lines 1120 as the weight 1139**.

Figure 12:
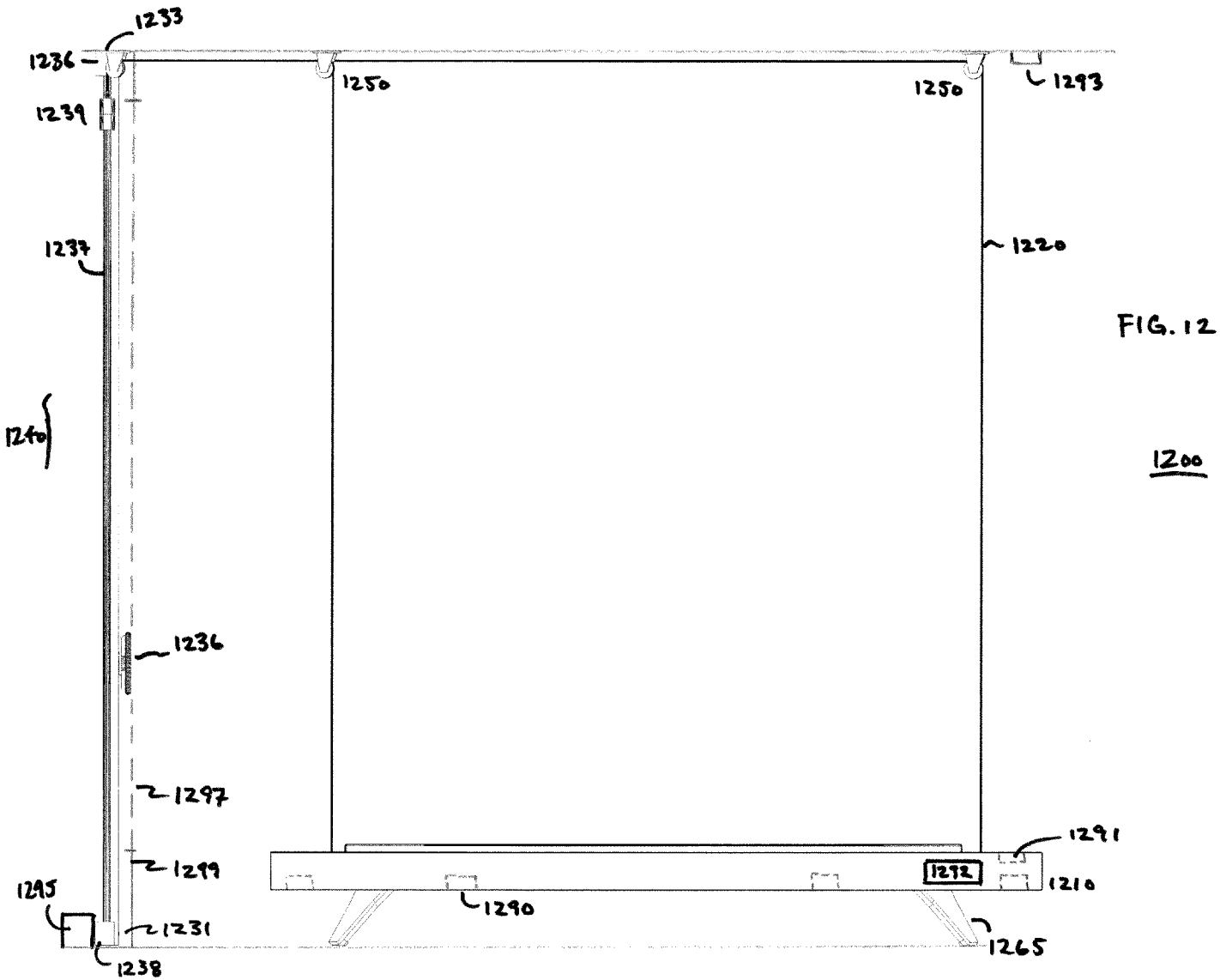
FIG. 12 is a side elevation view of an embodiment of a retractable bed configuration.

FIG. 12 is a side elevation view of an embodiment of a retractable bed configuration. The retractable bed system 1200 includes a frame 1210, legs 1265, support lines 1220, first blocks 1230, second blocks 1250 (only one pair of which is viewable), and a counterbalance system 1240. The counterbalance system 1240 includes a weight 1239, a base 1238, a top plate 1236, rails 1237, and a crank 1236. The support lines 1220 are attached to the weight 1239 and the weight is configured to slide along the rails 1237. The weight 1239 is also attached to the drive cable disposed between struts 1234. In the illustrated embodiment, the counterbalance system 1240 is disposed away from the frame 1210 behind a wall 1299. The wall optionally includes a cutout 1297 or viewing window allowing viewing of the counterbalance system 1240, which cutout 1297 may optionally include a transparent or translucent viewing window such as glass or plastic. The wall 1299 or viewing window may include a cutout for accommodating the crank 1236, or the crank may be mounted outside of the wall 1299 or cutout or viewing window 1297. In one embodiment, lights 1290 disposed in or under the frame 1210 are powered through an electrical feed or power line as illustrated, for example, in FIG. 6. In another embodiment, the frame 1210 houses a battery 1292 for powering the lights 1290. Optionally, the battery may be charged by way of an electrical connection 1291, 1293 made when the bed is raised to or near the ceiling. Optionally, an assist motor 1295 is provided to assist in the raising or lowering of the weight 1239 to move the bed. Optionally, the assist motor 1295 is activated only when the crank 1236 is being turned and provides help in addition to the manual operation of the crank 1236 to raise or lower the bed. Alternatively, the assist motor 1295 acts on the drive cable with sufficient power to raise or lower the bed on its own. Optionally, the assist motor is operated through the use of a remote control. Although the assist motor is shown to drive the first pulley 1231, it is understood that the assist motor can drive the second pulley or the crank itself. Additionally, an assist motor can act on the support lines 1220 themselves. In an alternative embodiment, multiple assist motors are provided.

Figure 13:
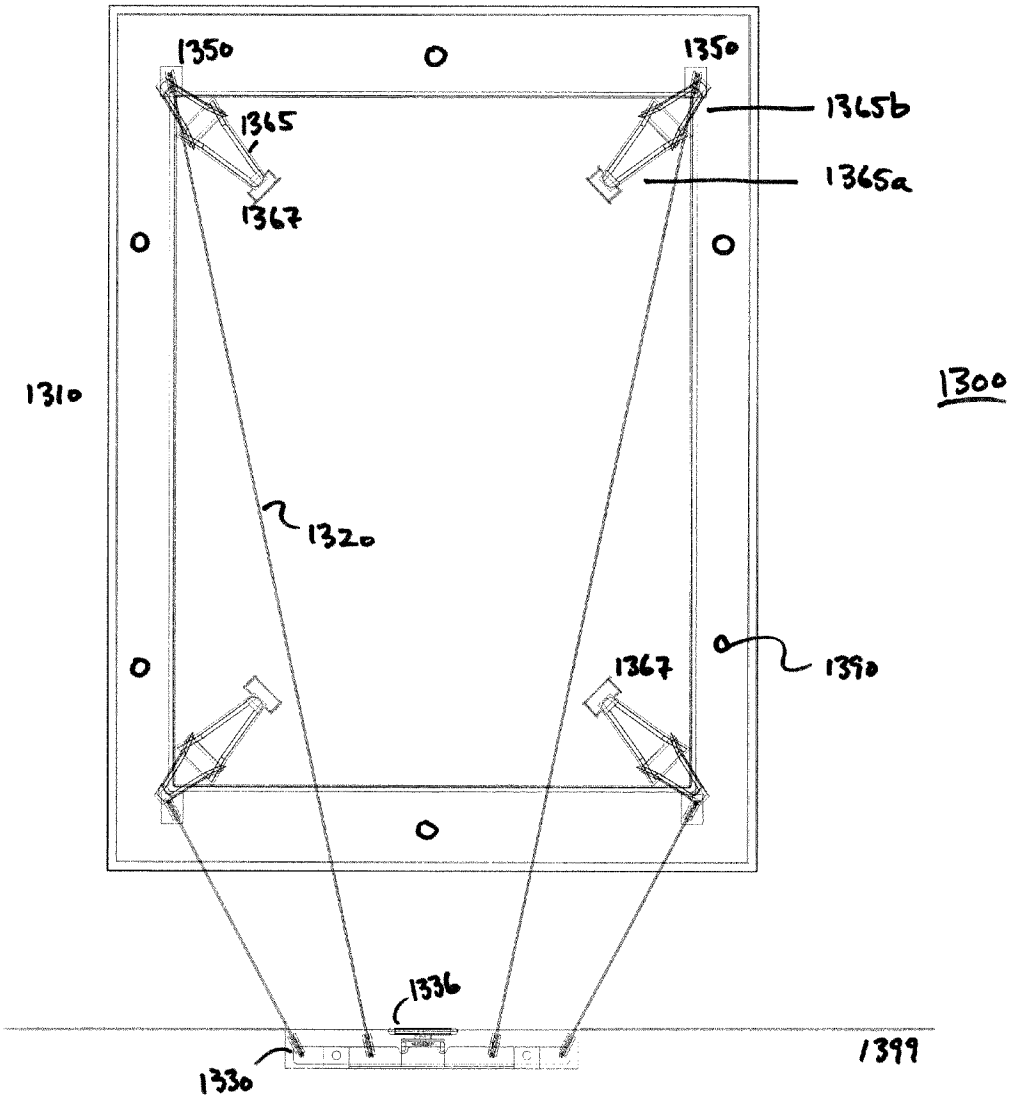
FIG. 13 is a plan view of an embodiment of a retractable bed configuration.

FIG. 13 is a plan view of an embodiment of a retractable bed configuration. The retractable bed system 1300 includes a frame 1310, legs 1365, support lines 1320, first blocks 1330, second blocks 1350, and a counterbalance system 1340. In the illustrated embodiment, the counterbalance system 1340, positioned flush with the surface of a wall 1399, includes a crank 1336 for manually raising and lowering the bed. In one embodiment, the legs 1365 are hingedly disposed on the bottom of the frame 1310 and deploy from a stowed position 1365*a* to an open position 1365*b*. Optionally, the legs 1365 are flush with the bottom of the frame 1310 in the stowed position 1365*a*. The hinging of the legs 1365 may be affected through the use of spring loaded or geared hinge. Optionally, the legs 1365 are secured in the stowed position 1365*a* through the use of a latch or lock 1367. The leg latches 1367 optionally are triggered to open when the frame 1310 is moved downward away from the ceiling.

Figure 14:
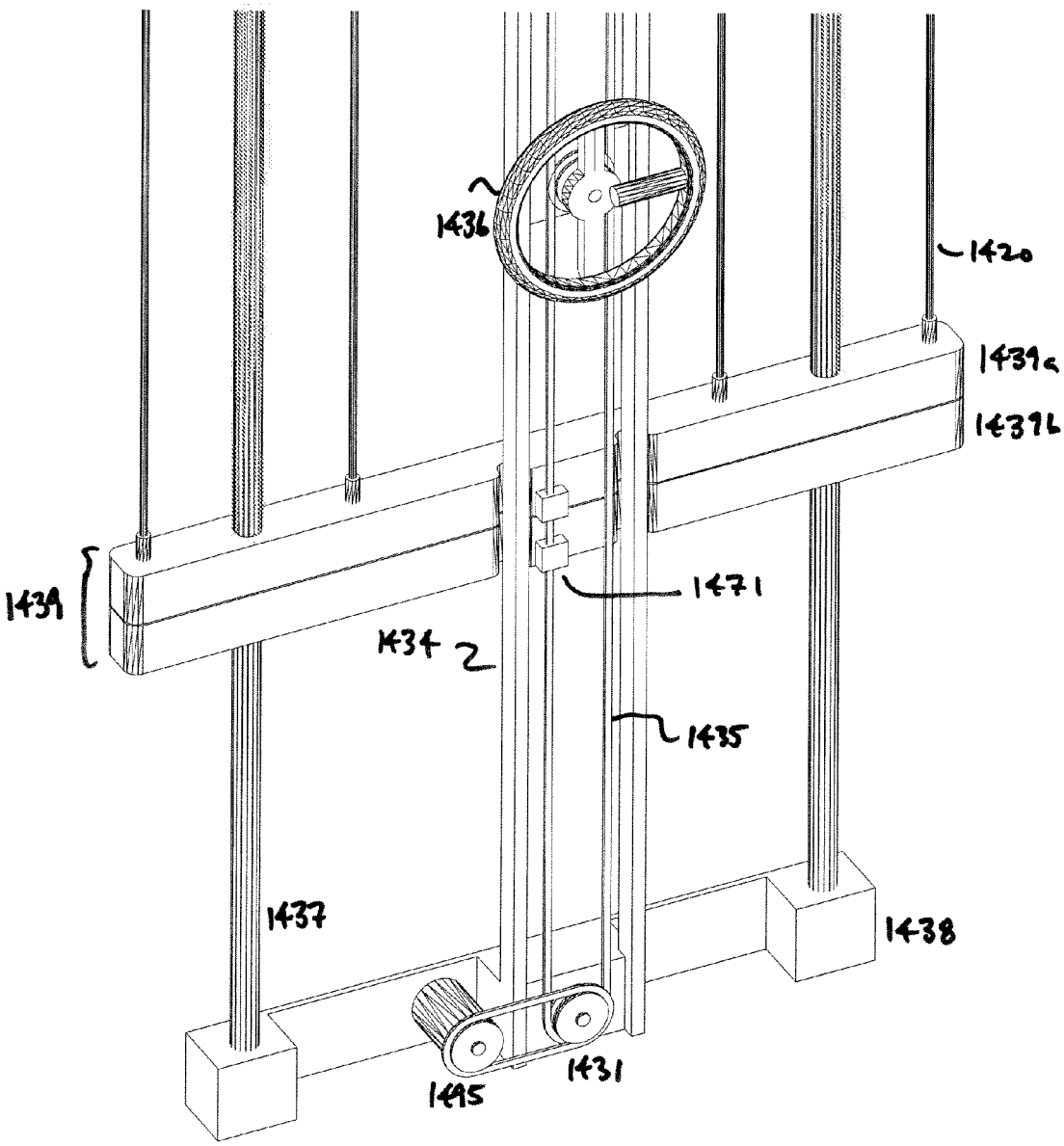
FIG. 14 is a diagram illustrating of an embodiment of a counterbalance system including a crank.

FIG. 14 is a diagram illustrating of an embodiment of a counterbalance system including a crank. In the illustrated embodiment, the weight 1439 including sections 1439*a*, 1439*b* are each secured to the drive cable 1435 at attachment points 1471. In another embodiment, only the standard section 1439*a* is attached to the drive cable 1435. In such an embodiment, the auxiliary section 1439*b* (of which there can be multiple ones thereof) is secured to the standard section 1439*a* so that actuating the crank 1436 translates the standard section 1439*a* along the rails 1437 by moving the cable 1435. In the illustrated embodiment, at the floor, there is a remote- or switch-controlled electric assist motor 1495 with a sprocket tied to the chain loop to lower and raise the weight, and thereby the bed. In an alternative embodiment, the motor 1495 directly turns the axle of the first pulley 1431 or sprocket. The motor 1495 may optionally be housed inside the base 1438.

Figure 15:
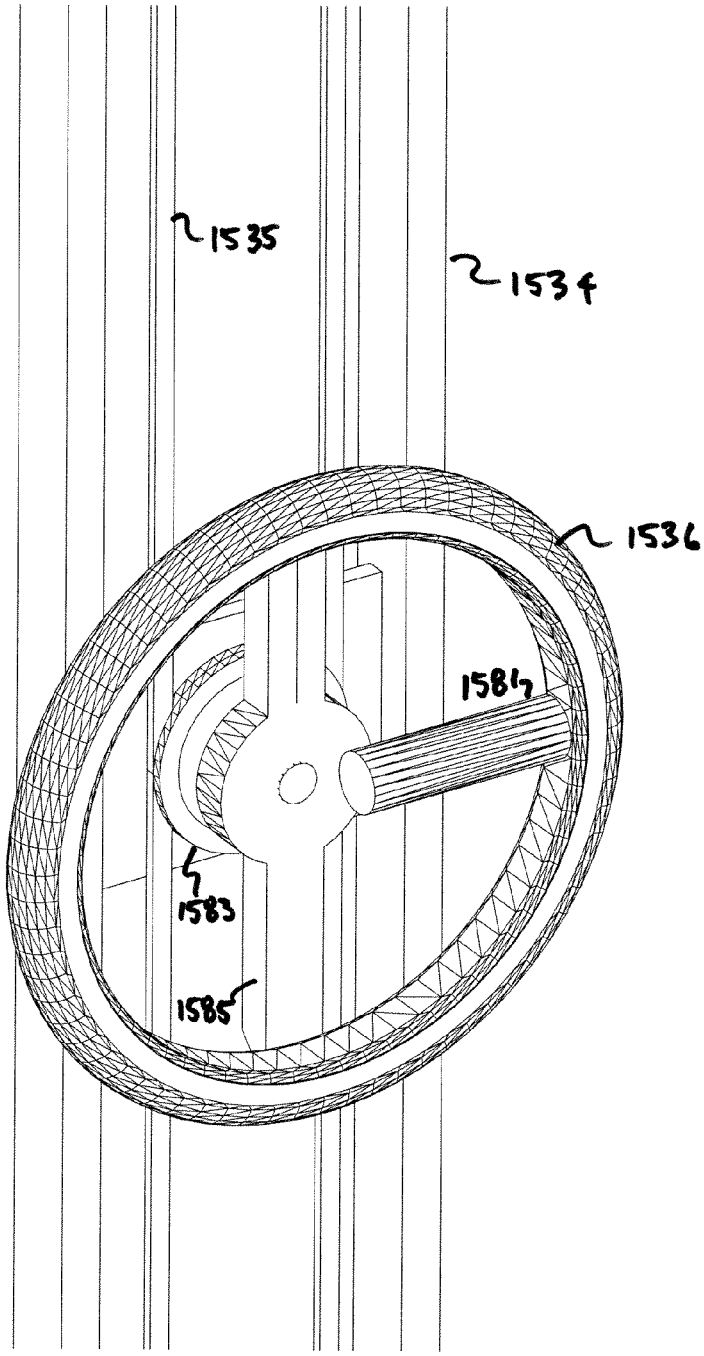
FIG. 15 is a diagram illustrating an embodiment of a crank with an undeployed handle.
Figure 16:
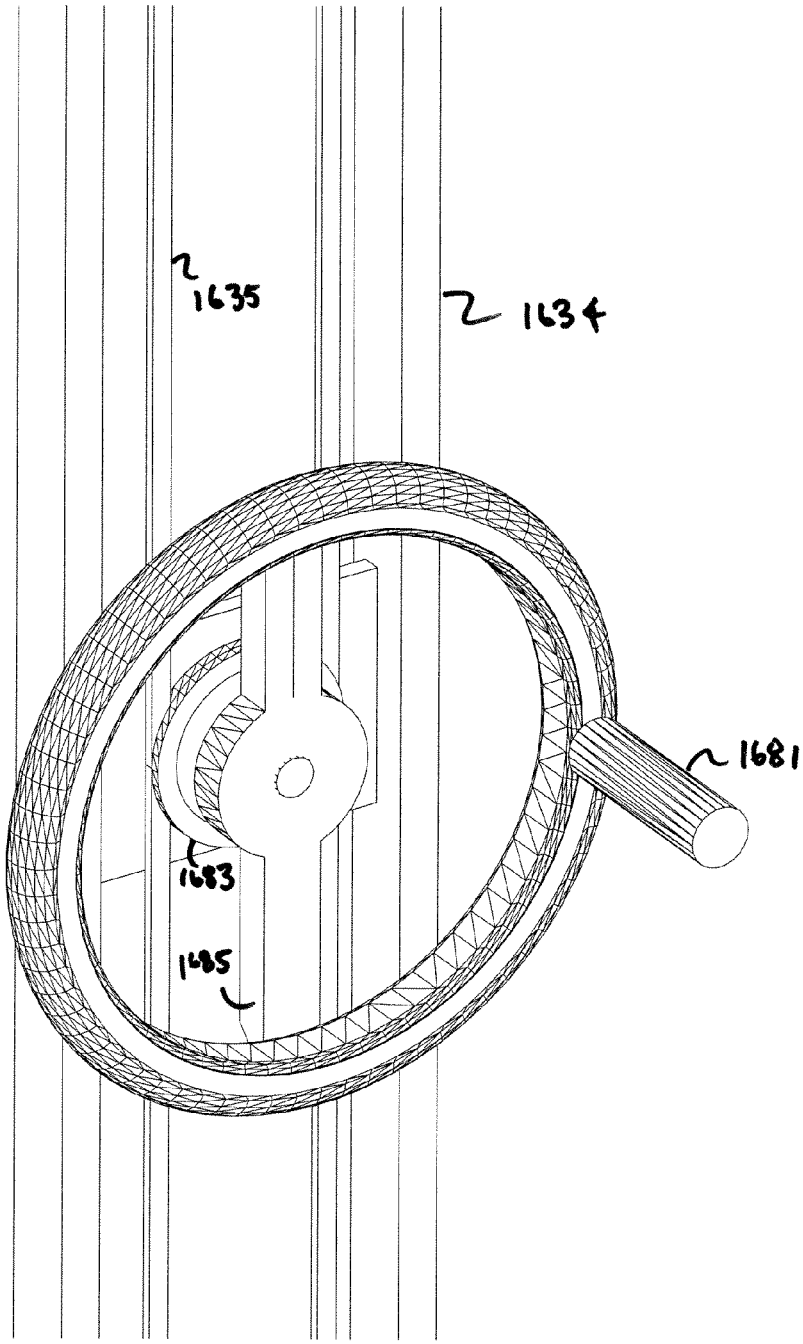
FIG. 16 is a diagram illustrating an embodiment of a crank with a deployed handle.

FIG. 15 is a diagram illustrating an embodiment of a crank with an undeployed handle. In the illustrated embodiment, the manually operated turn crank wheel 1536 includes a folding handle 1581 that, when pulled out, allows a user to rotate a pulley or sprocket 1583 connected to the crank 1536 behind the crank 1536 to move the drive cable clockwise or counterclockwise. The crank 1536 may optionally include a hub and spokes 1585 to allow the crank 1536 to engage the sprocket 1583 or pulley or gear that engages the drive cable 1535. FIG. 16 is a diagram illustrating an embodiment of a crank with a deployed handle. In the illustrated embodiment, the deployed handle 1681 is rotated outwardly. Optionally, the handle 1681 locks reversibly or releasably in this position to allow for easier rotation of the crank. Rotating the crank drives the drive cable 1635 by turning the hub and spokes 1685 connected to the sprocket or gear 1683.

In one embodiment, the counterbalance system is calibrated through the use of the weights to neutrally balance the frame and structures on the opposite end of the support lines. Additionally or in the alternative, the frictional resistance of the pulleys connected to the drive cable may be increased or decreased. In another embodiment, gearing is used to change the effort required to raise or lower the bed using the crank. As described above, one or more assist motors are provided to act on the drive cable or the support lines themselves.

In another embodiment, one or more sensors are provided for determining when the bed is in the raised or lowered configuration. As described above, the sensors may be mechanical devices or optical devices (laser sensors, well understood in the art) or electrical devices (e.g., switches) for measuring displacement of the unit or frame. Additionally, the sensor may also include an output device for outputting a visual or acoustic indicia that the bed is in the raised or lowered configuration.

Embodiments of systems and methods for have been described. In the foregoing description, for purposes of explanation, numerous specific details are set forth to provide a thorough understanding of the various embodiments. It will be appreciated, however, by one skilled in the art that the various embodiments may be practiced without these specific details. Additionally, in the foregoing detailed description, the various embodiments have been described with reference to specific exemplary embodiments. The specific embodiments are intended to exemplary only and, accordingly, the present specification and figures are to be regarded as illustrative rather than restrictive.

The invention claimed is:

1. A retractable bed, comprising:

a bed including a frame adapted to accommodate a mattress and legs;

support lines secured at one end to the frame at four support points of the frame;

a first block assembly disposed away from the frame and a second block assembly disposed above the frame, the second block assembly guiding the support lines from above the frame to the first block assembly; and a counterweight system neutrally weighted to the weight supported at a distal end by the support lines, the counterweight system being disposed separately from the bed and moving the bed through vertical displacement, and the counterweight system including a drive cable mechanically driven by a crank, an adjustable weight connected to the support lines through the first block assembly and connected to the drive cable, vertical rails confining the weight to translate along the vertical rails when the drive cable is driven by the crank.

2. The retractable bed of claim 1, further comprising:

an assist motor configured to drive one of the drive cable or the support lines.

3. The retractable bed of claim 1, wherein the counterweight system is separated from the frame by a wall.

4. The retractable bed of claim 1, wherein the legs are retractable.

5. The retractable bed of claim 1, further comprising:

lights disposed on a bottom surface of the frame.

6. A retractable bed, comprising:

a bed including a frame adapted to accommodate a mattress and legs;

support lines secured at one end to the frame at four support points of the frame;

a first block assembly disposed away from the frame and a second block assembly disposed above the frame, the second block assembly guiding the support lines from above the frame to the first block assembly; and counterweight means for moving the bed through vertical displacement disposed separately from the bed, the means being neutrally weighted to the weight supported at a distal end by the support lines.

7. The retractable bed of claim 6, further comprising:

an assist motor configured to drive one of the counterweight means or the support lines.

8. The retractable bed of claim 6, wherein the counterweight means is separated from the frame by a wall.

9. The retractable bed of claim 6, wherein the legs are retractable.

10. The retractable bed of claim 6, further comprising:

lights disposed on a bottom surface of the frame.

* * * * *